United States Patent [19]

Falkiewicz

[11] 4,125,303

[45] Nov. 14, 1978

[54] PORTABLE HOUSEHOLD FILE

[76] Inventor: Maria S. Falkiewicz, 43035 Hanford, Canton Township, Wayne County, Mich. 48187

[21] Appl. No.: 834,433

[22] Filed: Sep. 19, 1977

[51] Int. Cl.[2] ..... A47B 95/02

[52] U.S. Cl. ..... 312/244; 312/231; 312/233

[58] Field of Search ..... 312/9, 10, 231, 233, 312/244

[56] References Cited

U.S. PATENT DOCUMENTS

| | | | |
|---|---|---|---|
| 3,113,817 | 12/1963 | Imel | 312/244 |
| 3,374,041 | 3/1968 | Davis | 312/10 |
| 3,408,126 | 10/1968 | Mortensen | 312/244 |
| 3,604,773 | 9/1971 | Haynes et al. | 312/244 |

*Primary Examiner*—Casmir A. Nunberg
*Attorney, Agent, or Firm*—Charles W. Chandler

[57] ABSTRACT

A portable file comprising three file containers hinged together such that they may be either disposed in a compact side-by-side relationship for carrying or substantially separated for receiving documents into various file compartments.

5 Claims, 3 Drawing Figures

PORTABLE HOUSEHOLD FILE

BACKGROUND OF THE INVENTION

This invention is related to a file having three independently movable box-like file containers permitting the user to sort various household bills, receipts, and documents into an organized arrangement, and which are connected together so as to be conveniently carried as a compact unit.

Conventional household files normally comprise a box-like file having separators for organizing various materials into a classified arrangement. Other conventional files comprise an expanding envelope having separators for organizing file material.

SUMMARY OF THE INVENTION

The broad purpose of the present invention is to provide an improved portable household file system comprising three individual box-like file containers which when in a closed condition, resemble a diplomat case, but when open, provides a complete and organized system for keeping an up-to-date record of household expenses, and for facilitating the organization of tax materials.

In the preferred embodiment of the present invention, which will be described in greater detail, the preferred household file comprises a main file container compartmented for holding file folders. A second file container is hinged to one side of the main file container. The second container is also compartmented for holding various bank and other financial files. A third file container is hinged to the opposite side of the main file container for holding pending material such as a family journal, budget sheets, and unpaid bills. The three containers are disposed in a compact side-by-side relationship. Such an arrangement is particularly useful because it permits the user to efficiently maintain all household and personal financial data.

These and other advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
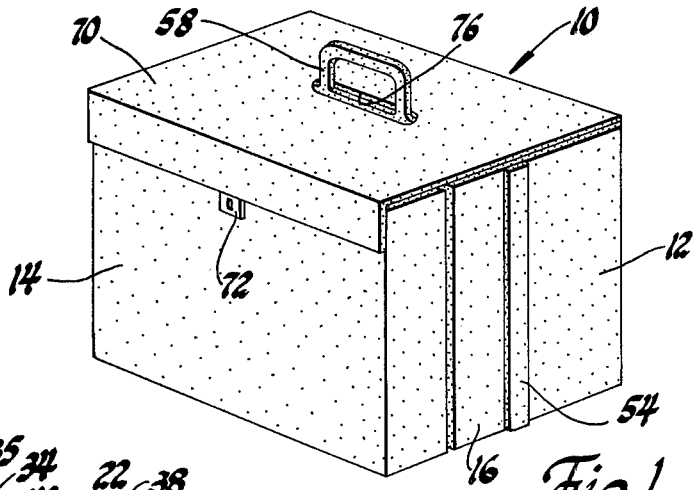
FIG. 1 is a perspective view of a household file illustrating the preferred embodiment of the invention in its closed position.

Referring to the drawing, a preferred household file, illustrated at 10, in FIG. 1 comprises a first box-like file container 12, a second box-like file container 14, and a third box-like file container 16.

File container 12 has a pair of long parallel sidewalls 18 and 20, connected to a pair of short sidewalls 22 and 24. Container 12 has a closed bottom (not shown) and a top for receiving conventional file folders (not shown). A plurality of separators 26 disposed within container 12 divide the container interior into a series of compartments for organizing the file folders into an alphabetical arrangement.

Container 14 has a pair of spaced, parallel long sidewalls 28 and 30 connected to a pair of short, parallel sidewalls 32 and 34 to cooperate with a closed bottom (not shown) to form a container having a top opening 35. Container 14 is substantially thinner than container 12. A plurality of separators 36 internally divide container 14 for organizing documentary material. A flap 37 is connected to wall 28 for closing opening 35.

A flexible hinge member 38 is removably connected to a short flexible hinge member 40 by suitable fastener means to permit container 14 to be either entirely separated from container 12 or pivotally connected to container 12.

The third file container 16 has a pair of parallel long sidewalls 42 and 44 connected to a pair of parallel short sidewalls 46 and 50 to cooperate with a closed bottom (not shown) to form a container having a top opening 51. A plurality of separator means 52 internally divide container 16 for organizing household documents. A flap 53 is connected to sidewall 42 for closing the opening.

A short hinge member 54, removably connects container 16 to container 12. Container 16 is pivotally connected to container 12 so as to be relatively movable between a closed position illustrated in FIG. 2 in which long sidewall 44 is parallel to long sidewall 18, and a fully open position in which sidewall 50 is disposed parallel to sidewall 24.

A substantially rectangular writing panel 56 has its lower edge pivotally connected to the lower edge of sidewall 18. The upper edge of panel 56 is shaped to form handle means 58. When the writing panel is disposed in a horizontal position, it is useful for writing purposes. However, when the file is to be carried by the user, the writing panel is pivoted upwardly to a position in which it is disposed parallel to sidewall 18 and handle means 58 projects above the open tops of the three containers.

Container 12 has an insert 60 for storing stamps, a support 62 for carrying a writing instrument 64, an insert 66 for storing keys, and pocket 68 for business and credit card.

Container 16 has a pocket 78 for notepaper, and a pocket 80 for envelopes.

Velcro fastener means are preferably employed for releasably connecting hinge member 38 to hinge member 40, and for connecting hinge member 54 to container 12.

Figure 2:
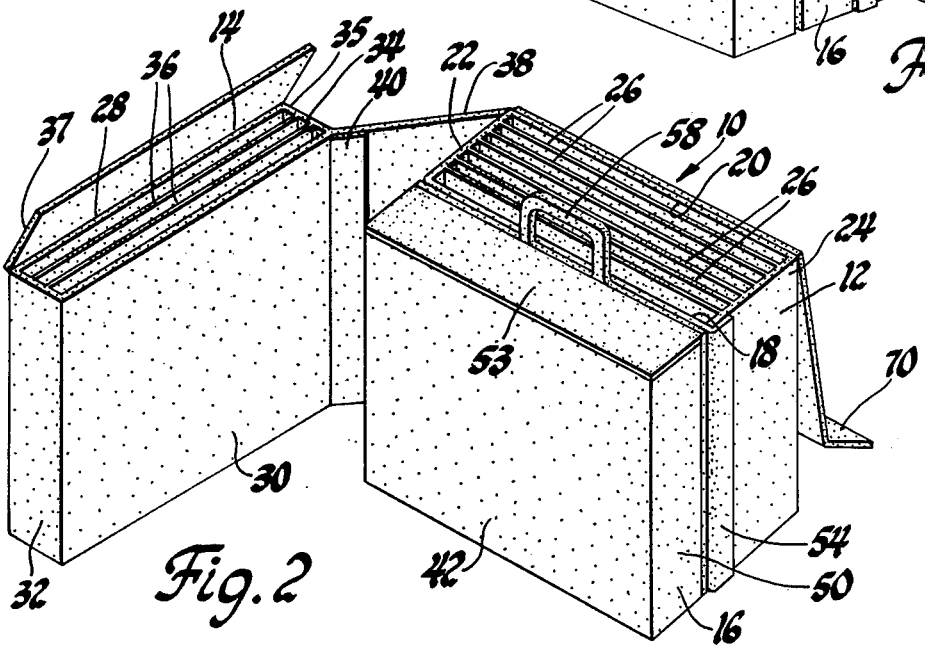
FIG. 2 is a view showing the preferred file with the cover open and one of the file containers separated from the other two file sections.
Figure 3:
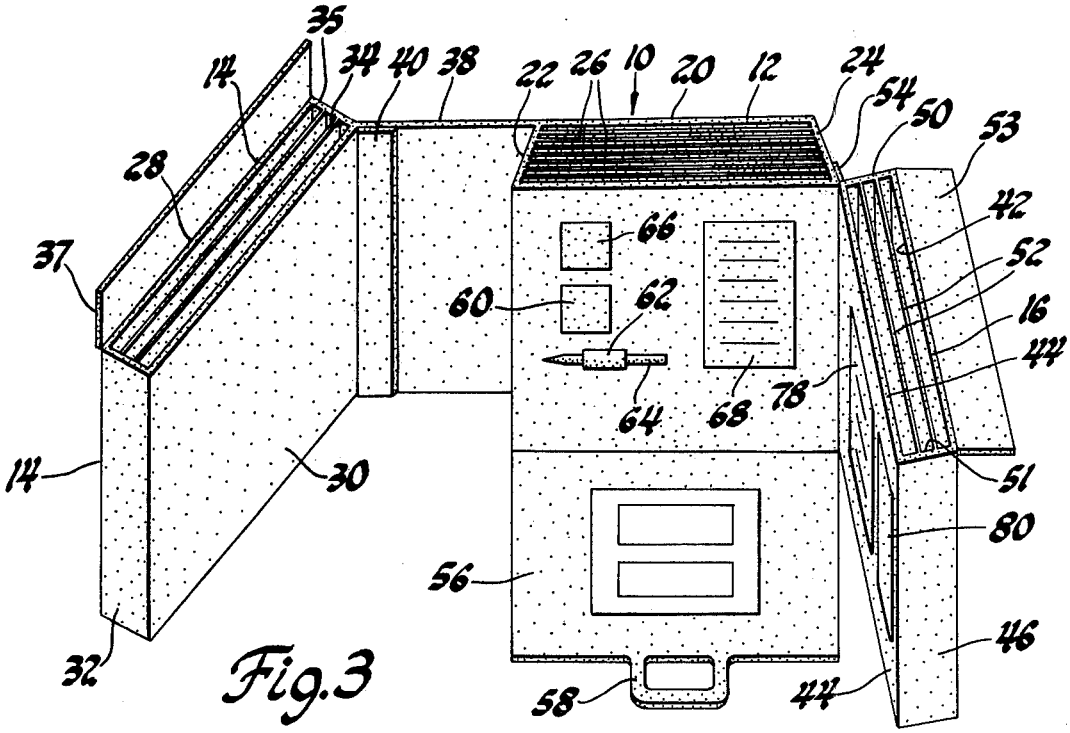
FIG. 3 is a view showing the three file containers in their respective open positions.

As best illustrated in FIGS. 1 and 2, a cover 70 has one edge connected to the top edge of container 12 and can be moved to a position in which it encloses the tops of the three file containers when they are in their side-by-side positions. Key-operated locking means 72 provides means for connecting the cover to file section 14 to maintain the entire file in a covered positions. A latch (not shown) mounted along the lower edge of sidewall 18 provides means for engaging cover 70 when containers 14 and 16 have been disconnected from container 12.

Cover 70 has an opening 76 for receiving handle means 58 to permit the user to conveniently carry the entire file assembly.

In use, file container 12 normally holds completed files arranged in an alphabetical A to Z manner. File container 14 is pivotally connected to main file container 12 and contains pending bills and other similar materials. Containers 12, 14, and 16 are thinner than container 12 because they hold fewer materials. File container 16 is pivotally connected to container 12 so that it can be opened to permit lowering of writing panel 56 to its writing position. When the writing panel is raised, container 16 can be disposed in a side-by-side relationship with container 12, and then container 14 closed to a position in which it is also in a side-by-side relationship with container 16. In their respective closed positions, the entire file provides a relatively compact assembly which can be readily carried and conveniently stored.

Having described my invention, I claim:

1. A portable household file comprising:

a first container having a pair of parallel, planar long sidewalls connected to a pair of parallel, planar short sidewalls to define a top opening for receiving filed material;

a second container having a pair of parallel, planar long sidewalls connected to a pair of parallel, planar short sidewalls to define a top opening for receiving filed material;

hinge means connecting the first container and the second container such that said containers are relatively movable between a first position in which the long sidewalls of the first container are parallel to the long sidewalls of the second container, and the top opening of said containers permits removal of filed material from the containers, and a second position in the long sidewalls of the first container are disposed at an angle with respect to the long sidewalls of the second container;

a planar writing panel pivotally connected to the first container so as to be movable between an upper position in which it is disposed parallel to the long sidewalls of the first container and the second container, and a lower writing position in which the panel is disposed at right angles to the sidewalls of the first container and the second container at such times as they are in their second position;

a cover member connected to one of such containers for enclosing the top openings of the first container and the second container in their first position; and handle means connected to said containers for carrying same.

2. A portable household file as defined in claim 1, in which the handle means comprises a handle member attached to the writing panel so as to extend above the top openings of the first container and the second container in said upper position, and including an opening in the cover for receiving the handle member such that it extends above such containers.

3. A portable household file as defined in claim 1, including a third container having a pair of parallel, planar long sidewalls connected to a pair of parallel, planar short sidewalls to define a top opening for receiving filed material, and in which said cover encloses the top opening of the third container at such times as it encloses the top opening of the first container and the second container.

4. A portable household file as defined in claim 3, in which the cover means is attached to the first container, and including latch means for connecting the cover means to the third container at such time as the second container and the third container are disposed in a side-by-side position.

5. A portable household file as defined in claim 1, in which the top openings of the first container and the second container permit removal of files of material in a common direction with respect to said containers by a motion parallel to said long sidewalls.

* * * * *